US010415523B2

(12) United States Patent
Blatterer et al.

(10) Patent No.: US 10,415,523 B2
(45) Date of Patent: Sep. 17, 2019

(54) FUEL INJECTION VALVE

(71) Applicant: Robert Bosch GmbH, Stuttgart (DE)

(72) Inventors: Dieter Blatterer, Enns (AT); Gerhard Girlinger, Leonding (AT); Roland Mitter, Gramastetten (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/792,019

(22) Filed: Oct. 24, 2017

(65) Prior Publication Data

US 2018/0112638 A1 Apr. 26, 2018

(30) Foreign Application Priority Data

Oct. 25, 2016 (DE) ..... 10 2016 220 912

(51) Int. Cl.
*F02M 51/06* (2006.01)
*F02M 61/18* (2006.01)

(52) U.S. Cl.
CPC .... *F02M 51/0692* (2013.01); *F02M 61/1886* (2013.01)

(58) Field of Classification Search
CPC ..... F02M 51/0692; F02M 61/1886
USPC ..... 239/96, 585.1–585.5
See application file for complete search history.

(56) References Cited

U.S. PATENT DOCUMENTS 6,488,220 B2 * 12/2002 Girlinger ..... F02M 47/027 239/585.1
6,874,709 B2 * 4/2005 Ricco ..... F02M 47/027 239/585.1
7,191,963 B2 * 3/2007 Cobianchi ..... F02M 47/027 239/585.1
2008/0283634 A1 * 11/2008 Hlousek ..... F02M 47/027 239/585.5

FOREIGN PATENT DOCUMENTS

DE 102007025614 12/2008

* cited by examiner

*Primary Examiner* — Christopher S Kim
(74) *Attorney, Agent, or Firm* — Michael Best & Friedrich LLP

(57) ABSTRACT

Fuel injection valve having a magnet armature (18) which interacts with a valve seat (19), which is formed on a valve piece (15), in order to open and close an outflow opening (20), wherein the magnet armature (18) can be moved away from the valve seat (19) by an electromagnet (24). A valve piece (15) delimits a control chamber (12), wherein the outflow opening (20) opens into the control chamber (12), and the control chamber (12) can be charged with fuel at high pressure that exerts a hydraulic force on the valve piece (15). Between the magnet armature (18) and the valve piece (15), there is arranged a bracing element (30) which is preloaded against the valve piece (15) and which exerts a force on the valve piece (15) in the region of the outflow opening (20) in the direction of the control chamber (12).

19 Claims, 5 Drawing Sheets

FUEL INJECTION VALVE

BACKGROUND OF THE INVENTION

The invention relates to a fuel injection valve such as is used for example for the injection of fuel into the combustion chamber of an internal combustion engine.

The prior art has disclosed fuel injection valves, such as are used for example for injecting fuel into the combustion chamber of an internal combustion engine. Here, fuel that has been compressed by a high-pressure pump is injected at high pressure directly into a combustion chamber of an internal combustion engine. Here, for the dosing of the fuel, a nozzle needle is used which is arranged in longitudinally displaceable fashion in a housing of the fuel injection valve. Said nozzle needle, by means of its longitudinal movement, opens up one or more injection openings through which the compressed fuel can emerge into the combustion chamber. Owing to the high pressure of the fuel, the fuel is finely atomized in the process, such that an effective combustion of the fuel occurs in the combustion chamber.

The movement of the nozzle needle is controlled by a varying pressure in a control chamber. The control chamber is delimited by that face side of the nozzle needle which is averted from the injection openings, such that the pressure in the control chamber exerts on the nozzle needle a hydraulic closing force which pushes said nozzle needle against a nozzle seat. Hydraulic forces in a pressure chamber which surrounds the nozzle needle and which is filled with highly pressurized fuel during operation exert on the nozzle needle a hydraulic opening force which is directed counter to the closing pressure arising from the hydraulic pressure in the control chamber. If the pressure in the control chamber is lowered, the opening hydraulic pressure on the nozzle needle prevails, and said nozzle needle thereupon moves away from the nozzle seat and opens up the injection openings.

For the adjustment of the pressure in the control chamber, a control valve is used which is formed for example as a magnetic valve, such as is known for example from the laid-open specification DE 10 2007 025 614 A1. The control valve disclosed in said document is constructed as follows: an outflow opening is formed in a valve piece which delimits the control chamber, via which outflow opening fuel can flow out of the control chamber into a low-pressure region, which lowers the pressure in the control chamber. For the opening and closing of the outflow opening, a magnet armature is used which can be moved by means of an electromagnet. Here, the elements within the fuel injection valve are fixed by means of a magnet spring which pushes the electromagnet against the valve piece via a sleeve or some other bracing element. In this way, the parts remain in place during operation, but can nevertheless be easily installed.

The maximum stroke of the magnet armature is determined by the spacing of the valve piece to the electromagnet and is of major significance for two reasons. Firstly, the magnet armature must be able to move over a certain distance in order that the outflow opening opens up an adequately large outflow cross section and thus permits a rapid pressure reduction in the control chamber. Secondly, the spacing of the electromagnet to the magnet armature determines the magnetic force acting on the magnet armature and thus the dynamics of the opening process when the electromagnet is actuated out of its closed position. In the case of the known fuel injection valves having a magnetic valve of said type, however, a situation may arise in which the valve piece is deformed slightly by the pressure in the control chamber. As a result, the seat of the magnet armature on the valve piece moves in the direction of the electromagnet, and thus shortens the maximum stroke of the magnet armature. Correspondingly, the dynamics of the control valve, and thus also the injection dynamics of the fuel injection valve, change, which can have an adverse effect on the control capability and thus on the combustion profile.

SUMMARY OF THE INVENTION

By contrast to this, the fuel injection valve according to the invention has the advantage that the maximum stroke of the magnet armature is constant over the entire service life, and in particular does not change owing to the pressure of the fuel for injection. For this purpose, the fuel injection valve has a magnet armature which interacts with a valve seat, which is formed on a valve piece, in order to open and close an outflow opening, wherein the magnet armature can be moved away from the valve seat by an electromagnet. The valve piece delimits its control chamber, into which the outflow opening opens out and which can be charged with fuel at high pressure, wherein the pressure in the control chamber exerts a hydraulic force on the valve piece in the region of the outflow opening in the direction of the magnet armature. Between the magnet armature and the valve piece, there is arranged a bracing element which is preloaded against the valve piece and which exerts a force on the valve piece in the region of the outflow opening in the direction of the control chamber.

Owing to the force exerted on the valve piece in the region of the outflow opening by the bracing element, the following occurs in the event of a deformation of the valve piece in the region of the outflow opening: owing to the pressure in the control chamber, the valve piece bulges in the direction of the magnet armature and, in the process, likewise pushes the bracing element in the direction of the electromagnet. The electromagnet is also moved in the same direction by the bracing element, such that, altogether, the spacing between the electromagnet and the valve piece remains constant, regardless of the intensity with which the valve piece is deformed by the internal pressure in the control chamber. Thus, the maximum stroke of the magnet armature always remains constant even in the event of an intense deformation of the valve piece, and thus the injection characteristic of the fuel injection valve also always remains the same.

In a first advantageous refinement of the invention, the bracing element is formed as a holed disk which has a central opening through which the magnet armature extends. In this way, the magnet armature can continue to be operated in its form known from the prior art, and the bracing element can be easily designed so as to achieve the desired effect.

In a further advantageous embodiment, the valve seat is of ring-disk-shaped form and, here, surrounds the outflow opening. A valve seat of said type can be formed easily and permits a rotationally symmetrical form of the control valve.

In a further advantageous refinement, the bracing element is preloaded against the valve piece by means of a sleeve, wherein the sleeve is supported with its other end on the electromagnet. In this way, in the event of a movement of the bracing element in the direction of the electromagnet, the latter is held with a constant spacing to the bracing element, such that, in the event of a deformation of the valve piece, both the valve piece itself and the electromagnet move in the same way in one direction.

In a further advantageous refinement, the electromagnet is preloaded in the direction of the valve piece by a magnet spring. This firstly secures the position of the electromagnet within the fuel injection valve, and secondly permits simple and inexpensive installation.

In a further advantageous refinement, the magnet armature is preloaded against the valve seat by an armature spring. In this way, the mobility of the magnet armature is ensured, because it is movable in the other direction by the electromagnet. Here, the arrangement of the armature spring within the electromagnet can be manufactured in a particularly space-saving and effective manner, such that, altogether, a compact construction of the magnetic valve is achieved.

In a further advantageous refinement, the bracing element lies on a circular-ring-shaped region on the valve piece, wherein the circular-ring-shaped region surrounds the valve seat and the outflow opening, and thereby allows the force to be introduced into the valve piece close to the outflow opening and symmetrically with respect to the valve seat, such that a deformation of the valve piece by the internal pressure in the control chamber leads to a translational movement of the bracing element and not to a tilting movement.

It is furthermore particularly advantageous for the valve seat to be formed as a flat seat because good mobility of the bracing element and of the electromagnet is ensured in this way.

BRIEF DESCRIPTION OF THE DRAWINGS

The drawing schematically illustrates various exemplary embodiments of the fuel injection valve according to the invention in longitudinal section. In the drawing.

DETAILED DESCRIPTION

Figure 1:
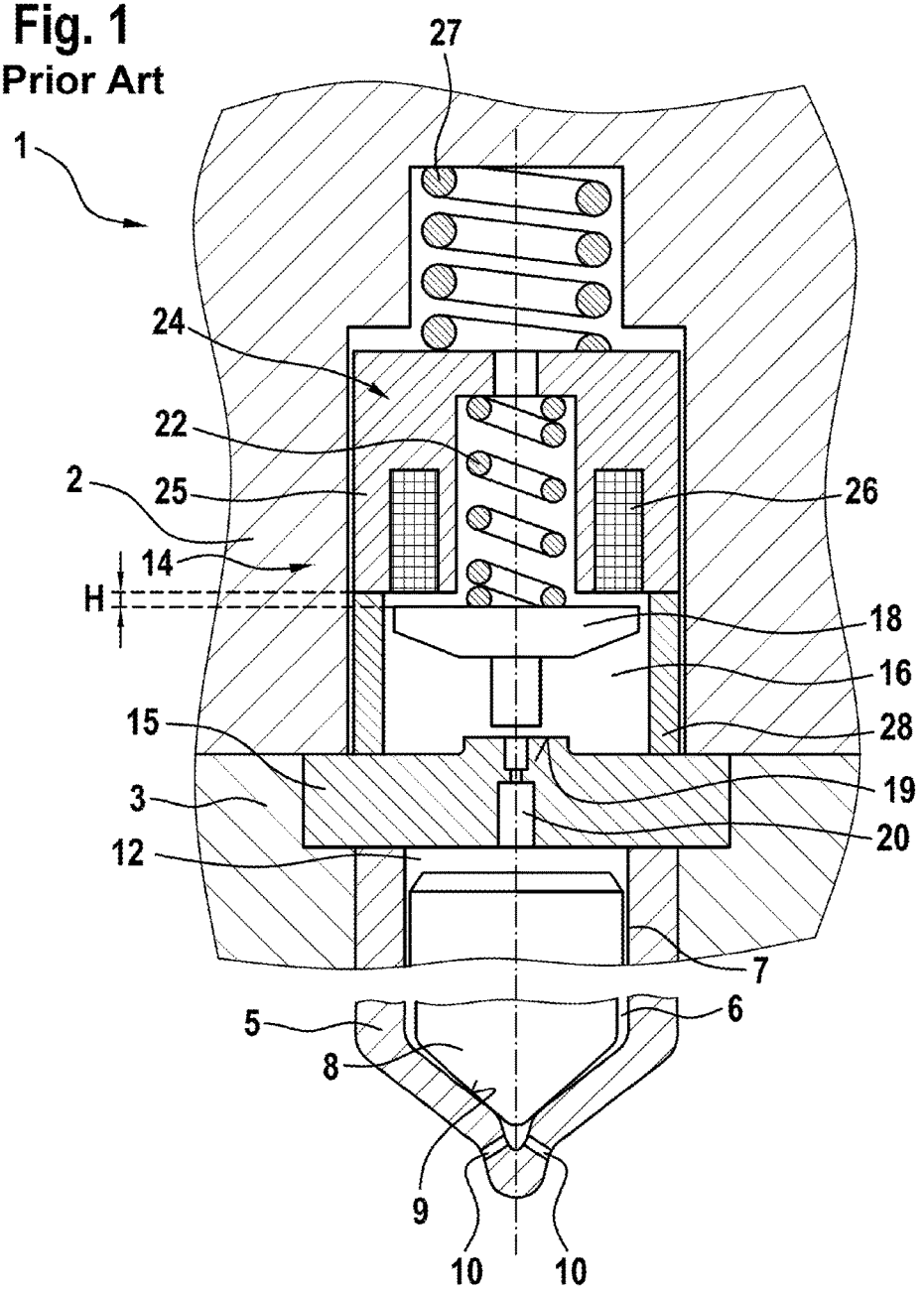
Fig. 1 Prior Art
FIG. 1 shows a longitudinal section through a fuel injection valve such as is known from the prior art.

FIG. 1 schematically illustrates a fuel injection valve known from the prior art in longitudinal section, with only the main parts of the fuel injection valve being illustrated. The fuel injection valve has a housing 1 which comprises a valve body 2, a holding body 3 and a nozzle body 5, which are braced against one another in liquid-tight fashion in said sequence by bracing devices (not shown). In the holding body 3 there is formed a bore 7 which extends into the nozzle body 5 and in which a piston-like nozzle needle 8 is arranged in longitudinally displaceable fashion. Here, the nozzle needle 8 interacts with a nozzle seat 9 formed in the nozzle body 5, such that, when the nozzle needle 8 bears against the nozzle seat 9, injection openings 10 which are formed on the combustion-chamber-side end of the nozzle body 5 are closed off with respect to a pressure chamber 6 which surrounds the nozzle needle 8 in the region of the nozzle body 5. The pressure chamber 6 is in this case charged with fuel at high pressure, which is compressed, and supplied to the fuel injection valve, by a high-pressure pump (not shown in any more detail).

The fuel pressure in the pressure chamber 6 exerts on the nozzle needle 8 an opening force which is directed in an opening direction, that is to say away from the nozzle seat 9, but which counteracts a hydraulic closing force which is generated by the fuel pressure in a control chamber 12. Here, the control chamber 12 is delimited by that face side of the nozzle needle 8 which is averted from the nozzle seat 9, and at the opposite side by a valve piece 15. The control chamber 12 is connected via a feed line (not shown) to the pressure chamber 6, such that it can always be charged with fuel at high pressure via said feed line. The hydraulic forces exerted on the nozzle needle 8 by the pressure in the pressure chamber 6 and in the control chamber 12 are configured such that, when an equal pressure prevails in the control chamber 12 and in the pressure chamber 6, the nozzle needle 8 is pushed hydraulically against the nozzle seat 9 and thus closes off the injection openings 10.

A control valve 14 serves for the regulation of the pressure in the control chamber 12. Here, the control valve 14 comprises a magnet armature 18 which is arranged in longitudinally displaceable fashion in an outflow chamber 16 formed in the valve body 2. The magnet armature 18 interacts with a valve seat 19 in order to open and close an outflow opening 20, wherein the valve seat 19 is formed on the valve piece 15 and surrounds the opening-out point of the outflow opening 20 into the outflow chamber 16 in the manner of a ring-shaped disk, such that, when the magnet armature 18 bears against the valve seat 19, the outflow opening 20 is closed off with respect to the outflow chamber 16. For the movement of the magnet armature 18, an electromagnet 24 is used which comprises a magnet core 25 with a magnet coil 26 formed therein. If the magnet coil 26 is electrically energized, the electromagnet 24 exerts an attractive force on the magnet armature 18, such that said magnet armature is pulled away from the valve seat 19 in the direction of the electromagnet 24. The movement of the magnet armature 18 occurs in this case counter to the force of an armature spring 22 which is arranged in a recess in the electromagnet 24. The armature spring 22 also ensures that, when the electrical energization of the magnet coil 26 is interrupted, the magnet armature 18 moves back into its closed position again, that is to say into contact with the valve seat 19.

The axial spacing between the electromagnet 24 and the valve piece 15 denotes the maximum stroke H of the magnet armature 18. To keep said maximum stroke constant, a sleeve 28 is arranged between the electromagnet 24 or the magnet core 25 and the valve piece 15, the axial length of which sleeve ultimately defines the maximum stroke H. To hold the electromagnet 24 in place, a magnet spring 27 is provided which preloads the electromagnet 24 against the valve piece 15 via the sleeve 28. If the electromagnet 24 is now electrically energized, it moves the magnet armature 18 away from the valve seat 19 and opens up the outflow opening 20. As a result, the pressure in the control chamber 12 falls, because fuel flows out via the outflow opening 20 into the outflow chamber 16, and the hydraulic closing force on the nozzle needle 8 correspondingly falls. Said nozzle needle is thus moved away from the nozzle seat 9 by hydraulic forces in the pressure chamber 6, and opens up the injection openings 10 such that fuel passes from the pressure chamber 6 via the injection openings 10 into the combustion chamber of the internal combustion engine. To end the injection, the electrical energization of the electromagnet 24 is ended, such that the armature spring 22 pushes the magnet armature 18 back into contact with the valve seat 19, which closes the outflow opening 20 again. The fuel pressure that builds up again in the control chamber 12 owing to the follow-up inflow of fuel pushes the nozzle needle 8 back into its closed position against the nozzle seat 9, such that the injection openings 10 are closed again.

Figure 2:
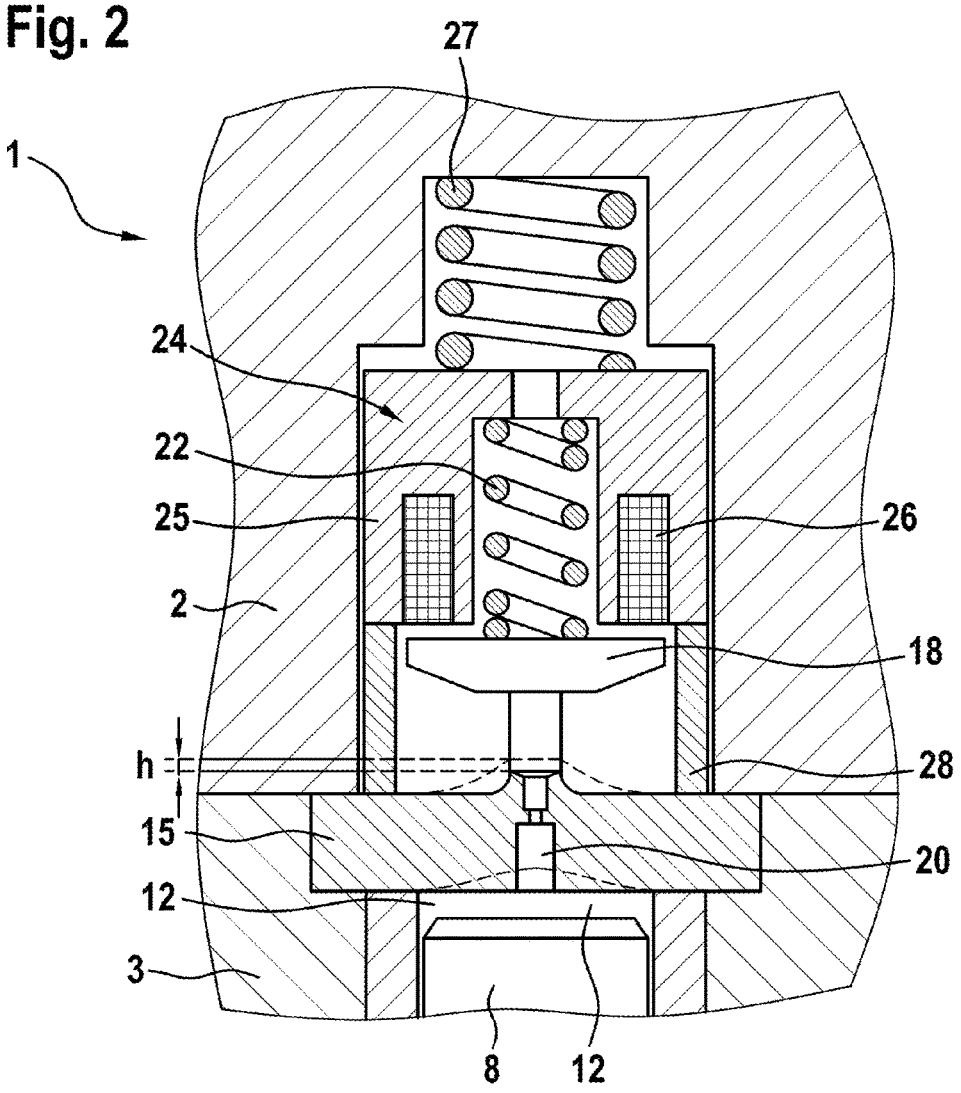
FIG. 2 shows the same fuel injection valve, in this case likewise in a schematic illustration, with only the main parts being illustrated, and the influence of the internal pressure in the control chamber on the deformation of the adjacent components being illustrated on an exaggerated scale.

The fuel pressures used in the case of normal fuel injection are very high, and temporarily amount to 2000 bar (200 MPa) or even considerably higher. This results in a small but nevertheless significant deformation of the valve piece 15 by the fuel pressure in the control chamber 12, because it is always the case that only a very low fuel pressure prevails in the outflow chamber 16 on that side of the valve piece 15 which is averted from the control chamber 12. As a result, the valve piece 15 deforms, as illustrated by means of the dashed line in FIG. 2, such that the valve seat 19 is displaced by a distance h in the direction of the electromagnet 24. The maximum stroke H of the magnet armature 18 is thus also reduced by said distance h, because the spacing of the magnet armature 18 to the electromagnet 24 when the control valve is closed is also decreased. Since the magnetic force on the magnet armature 18 is very sensitive to the spacing to the electromagnet 24, the magnetic force on the magnet armature 18 is now increased, which changes the opening dynamics in the event of electrical energization of the electromagnet 24. This results in different injection dynamics, and thus in a change in quantity and injection time.

Figure 3:
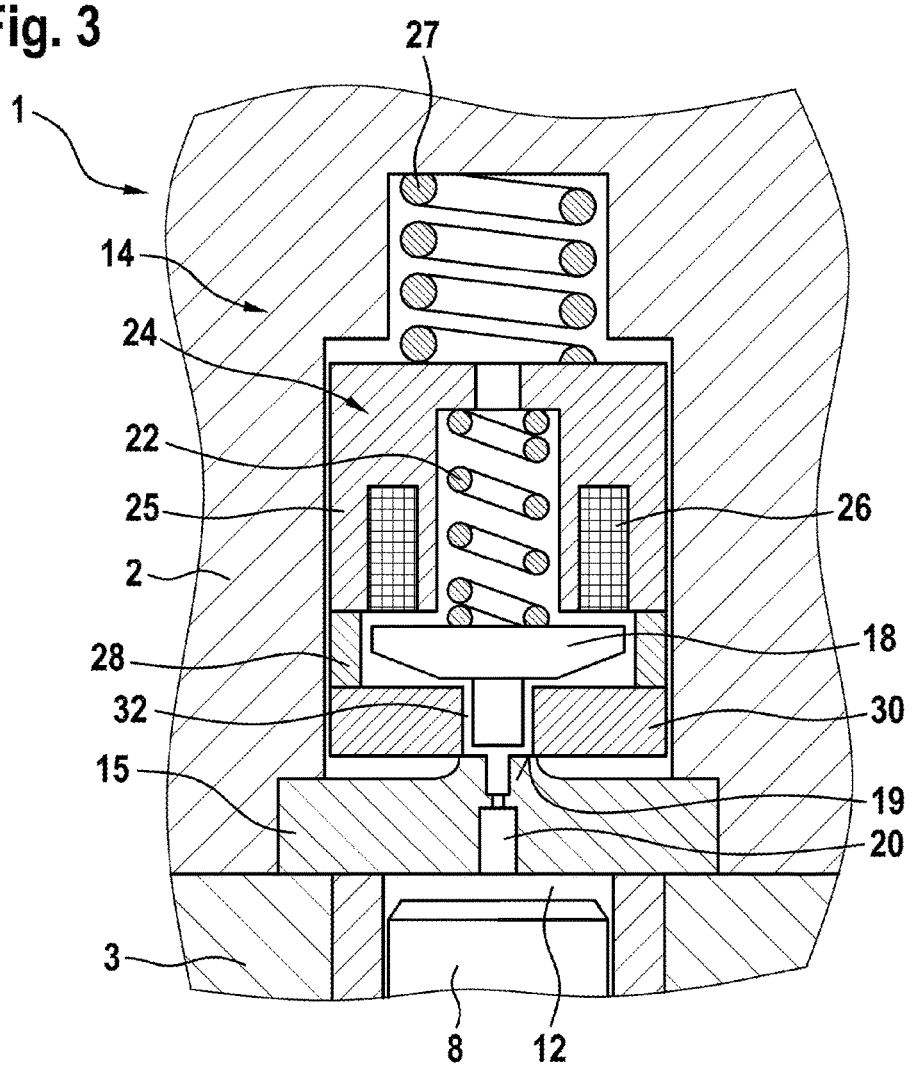
FIG. 3 shows a first exemplary embodiment of the fuel injection valve according to the invention.
Figure 4:
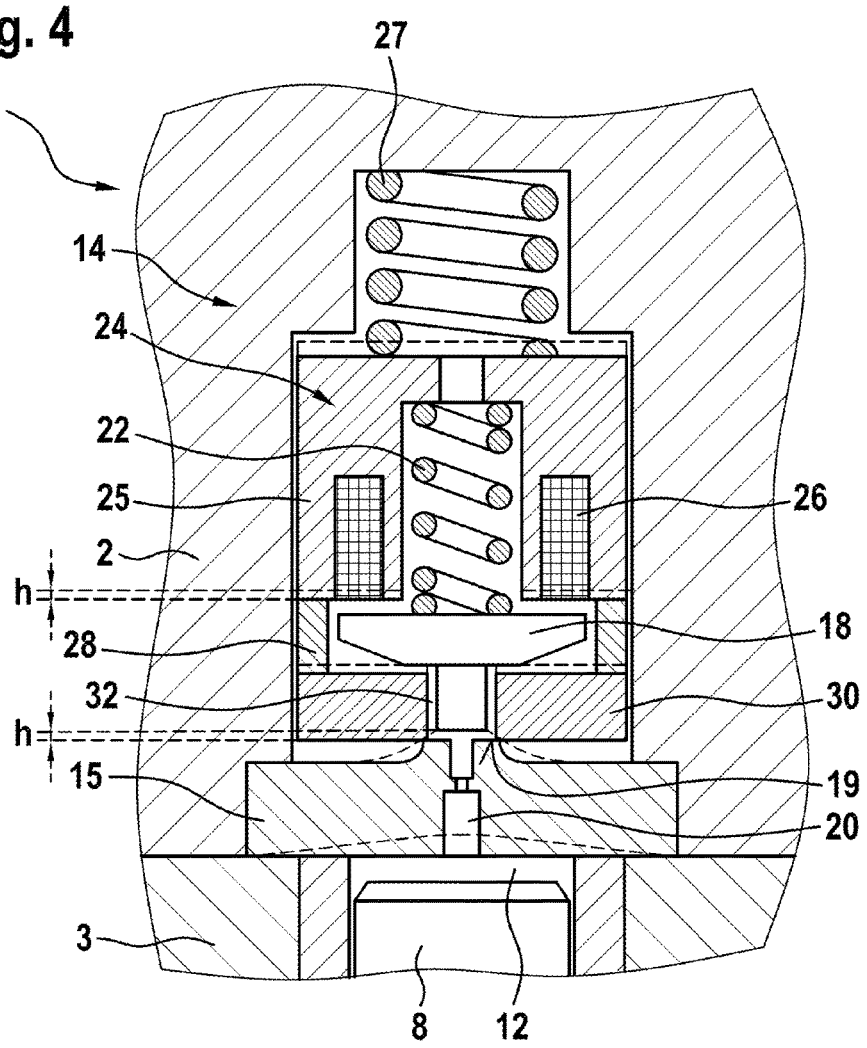
FIG. 4 shows, in the same illustration as FIG. 3, the effects of a deformation of the valve piece by the internal pressure in the control chamber.

FIG. 3 illustrates a first fuel injection valve according to the invention, wherein only the region of the control valve is illustrated in detail. The construction of the control valve 14 is, aside from the details discussed below, identical to the construction known from the prior art and shown in FIGS. 1 and 2. Instead of a sleeve 28 which supports the electromagnet 24 directly on the valve piece 15, a bracing element 30 is provided between the electromagnet 24 and the valve piece 15. The bracing element 30 is supported by the sleeve 28 on the electromagnet 24 and lies, at the other side, on the valve piece 15 in a circular-ring-shaped region surrounding the valve seat 19. As a result, the bracing force which is transmitted by means of the magnet spring 27 to the electromagnet 24, the bracing sleeve 28 and the bracing element 30 is exerted on the valve piece 15 in the region of the outflow opening 20. If a deformation of the valve piece 15 now occurs owing to the pressure in the control chamber 12, the state as illustrated in FIG. 4 arises. The valve piece 15 deforms, as has also already been shown in FIG. 2, in the direction of the electromagnet 24 in particular in the region of the outflow opening 20, and thereby displaces the valve seat 19 in the direction of the electromagnet 24. Owing to the bracing element 30, said electromagnet is also moved by the distance h in the direction of the electromagnet 24, such that, via the sleeve 28, the electromagnet 24 is also moved by the distance h counter to the force of the magnet spring 27. It is thus ultimately the case that the spacing between the valve seat 19 and the electromagnet 24, and thus also the maximum stroke H of the magnet armature 18, remain constant. If, in the event of such a deformation, the electromagnet 24 is electrically energized, then the spacing between the electromagnet 24 and the magnet armature 18 is of the same size as in the absence of said deformation. Thus, the magnetic forces, and thus the opening characteristic of the control valve 14, also remain the same. As a result of this independency of the injection pressure, a control valve 14 of said type can be used even in the case of very high injection pressures, which lead to an intense deformation of the valve piece 15. The distance h by which the valve seat 19 is moved here typically amounts to a few micrometers.

Figure 5:
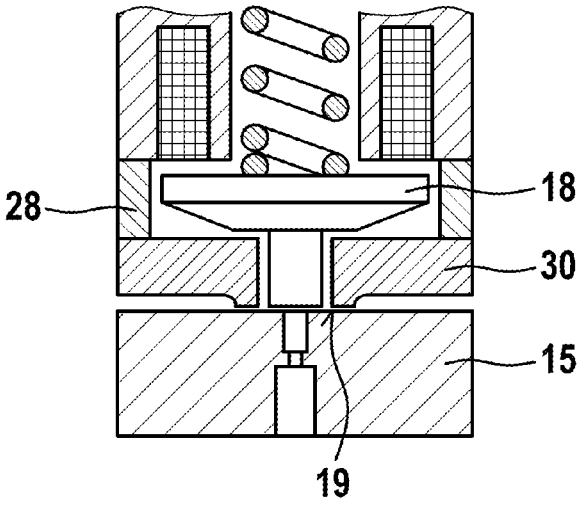
FIG. 5 shows a second exemplary embodiment of the fuel injection valve according to the invention, with only the region of the bracing element being illustrated.

To ensure that the bracing element 30 sets down on the valve piece 15 only in the region of a circular-ring-shaped disk which surrounds the outflow opening 20, the region of the valve seat 19 is of elevated form and projects beyond the otherwise flat side, facing toward the outflow chamber 16, of the valve piece. FIG. 5 illustrates an alternative embodiment in this regard. Here, the valve piece 15 has been ground so as to be completely flat on the side facing toward the outflow chamber 16. To nevertheless exert the forces in the region of the outflow opening 20, the bracing element 30 has a protrusion such that the axial forces are exerted on the valve piece 15 only in the region of the outflow opening 20. The functionality of this exemplary embodiment is otherwise identical to that shown in FIGS. 3 and 4.

The embodiment of the bracing element 30 as a holed disk is the simplest possibility for realizing a bracing element of said type in an electromagnet shown here. It is however also possible for some other form of the bracing element 30 to be provided which ensures that the force exerted on the electromagnet 24 by means of a magnet spring 27 or some other device is exerted on the valve piece 15 only in the region of the outflow opening 20.

The invention claimed is:

1. A fuel injection valve having a magnet armature (18) which is arranged in an outflow chamber (16) formed in a valve body (2) and interacts with a valve seat (19), which is formed on a valve piece (15), in order to open and close an outflow opening (20), wherein the magnet armature (18) is movable away from the valve seat (19) by an electromagnet (24), and having a control chamber (12) which is delimited by the valve piece (15), wherein the outflow opening (20) opens into the control chamber (12), and the control chamber (12) is configured to be charged with fuel at high pressure, wherein pressure in the control chamber (12) exerts a hydraulic force on the valve piece (15) in a direction of the magnet armature (18), wherein a bracing element (30) is arranged between the magnet armature (18) and the valve piece (15), wherein one of the valve piece (15) or the bracing element (30) includes a protrusion positioned about the outflow opening (20) and radially inward of an outer edge of the valve piece (15) such that the protrusion does not contact the outer edge, and wherein the bracing element (30) is preloaded against the valve piece (15) at the protrusion and exerts a force on the valve piece (15) at the protrusion in a direction of the control chamber (12), and wherein the bracing element (30) is preloaded against the valve piece (15) by a sleeve (28) that contacts a bottom side of the electromagnet (24) and a top side of the bracing element (30).

2. The fuel injection valve according to claim 1, characterized in that the bracing element is formed as a holed disk (30) which has a central opening (32) through which the magnet armature (18) extends.

3. The fuel injection valve according to claim 2, wherein the valve piece (15) includes the protrusion, characterized in that the valve seat (19) is formed at the protrusion, wherein the protrusion is in the form of a ring-shaped disk and surrounds the outflow opening (20).

4. The fuel injection valve according to claim 1, characterized in that the electromagnet (24) is preloaded in a direction of the valve piece (15) by a magnet spring (27).

5. The fuel injection valve according to claim 1, characterized in that the magnet armature (18) is preloaded against the valve seat (19) by an armature spring (22).

6. The fuel injection valve according to claim 5, characterized in that the armature spring (22) is arranged in an interior of the electromagnet (24).

7. The fuel injection valve according to claim 1, characterized in that the bracing element (30) lies on a circular-ring-shaped region defined by the protrusion, wherein the circular-ring-shaped region surrounds the outflow opening (20).

8. The fuel injection valve according to claim 1, characterized in that the valve seat (19) is formed as a flat seat.

9. The fuel injection valve according to claim 8, characterized in that the protrusion is in the form of a ring-shaped disk on the bracing element (30).

10. The fuel injection valve according to claim 1, characterized in that the bracing element (30) engages the valve piece (15) and exerts a force on the valve piece (15) only at the protrusion surrounding the outflow opening (20).

11. A fuel injection valve having a magnet armature (18) which interacts with a valve seat (19), which is formed on a valve piece (15), in order to open and close an outflow opening (20), wherein the magnet armature (18) is movable in an axial direction away from the valve seat (19) by an electromagnet (24), and having a control chamber (12) which is delimited by the valve piece (15), wherein the outflow opening (20) opens into the control chamber (12), and the control chamber (12) is configured to be charged with fuel at high pressure, wherein pressure in the control chamber (12) exerts a hydraulic force on the valve piece (15) in a region of the outflow opening (20) in a direction of the magnet armature (18), wherein a bracing element (30) is arranged between the magnet armature (18) and the valve piece (15), wherein one of the valve piece (15) or the bracing element (30) includes a protrusion positioned about the outflow opening (20) and located nearer to the outflow opening (20) than to an outer edge of the valve piece (15) in a radial direction perpendicular to the axial direction, and wherein the bracing element (30) is preloaded against the valve piece (15) and exerts a force on the valve piece (15) in the region of the outflow opening (20) at the protrusion in a direction of the control chamber (12).

12. The fuel injection valve according to claim 11, characterized in that the bracing element is formed as a holed disk (30) which has a central opening (32) through which the magnet armature (18) extends.

13. The fuel injection valve according to claim 12, wherein the valve piece (15) includes the protrusion, characterized in that the valve seat (19) is formed at the protrusion, wherein the protrusion is in the form of a ring-shaped disk and surrounds the outflow opening (20).

14. The fuel injection valve according to claim 11, characterized in that the bracing element (30) is preloaded against the valve piece (15) by a sleeve (28) which is supported with an end on the electromagnet (24).

15. A fuel injection valve having a magnet armature (18) which interacts with a valve seat (19), which is formed on a valve piece (15), in order to open and close an outflow opening (20), wherein the magnet armature (18) is movable away from the valve seat (19) by an electromagnet (24), and having a control chamber (12) which is delimited by the valve piece (15), wherein the outflow opening (20) opens into the control chamber (12), and the control chamber (12) is configured to be charged with fuel at high pressure, wherein pressure in the control chamber (12) exerts a hydraulic force on the valve piece (15) in a region of the outflow opening (20) in a direction of the magnet armature (18), wherein a bracing element (30) is arranged between the magnet armature (18) and the valve piece (15), wherein one of the valve piece (15) or the bracing element (30) includes a protrusion positioned about the outflow opening (20), wherein the bracing element (30) is preloaded against the valve piece (15) and exerts a force on the valve piece (15) in the region of the outflow opening (20) at the protrusion in a direction of the control chamber (12), wherein the electromagnet (24) is preloaded in a direction of the valve piece (15) by a magnet spring (27), and wherein the bracing element (30) is non-threaded and thereby configured to linearly translate against the magnet spring (27) to move the electromagnet (24) in response to deformation of the valve piece (15).

16. The fuel injection valve according to claim 15, characterized in that the magnet armature (18) is preloaded against the valve seat (19) by an armature spring (22).

17. The fuel injection valve according to claim 16, characterized in that the armature spring (22) is arranged in an interior of the electromagnet (24).

18. The fuel injection valve according to claim 15, characterized in that the bracing element (30) lies on a circular-ring-shaped region defined by the protrusion, wherein the circular-ring-shaped region surrounds the outflow opening (20).

19. The fuel injection valve according to claim 15, characterized in that the protrusion is positioned radially inward of an outer edge of the valve piece (15) such that the protrusion does not contact the outer edge.

* * * * *